US008237752B2

(12) United States Patent
Chou et al.

(10) Patent No.: US 8,237,752 B2
(45) Date of Patent: Aug. 7, 2012

(54) COLOR CALIBRATOR OF DISPLAY DEVICE

(75) Inventors: Chun-Hsien Chou, Taipei (TW); Ray-Chin Wu, Taipei (TW); Chih-Cheng Fu, Taipei (TW); Cheng-Chieh Wu, Taipei (TW); Shing-Shi Tseng, Miaoli County (TW); Chia-Ming Huang, Yilan County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 251 days.

(21) Appl. No.: 12/721,573

(22) Filed: Mar. 11, 2010

(65) Prior Publication Data

US 2011/0122160 A1 May 26, 2011

(30) Foreign Application Priority Data

Nov. 26, 2009 (TW) ..... 98140382 A

(51) Int. Cl.
*G09G 5/10* (2006.01)

(52) U.S. Cl. ..... 345/690; 345/589

(58) Field of Classification Search ..... 345/589, 345/600–604, 690, 204, 87–88; 382/167
See application file for complete search history.

(56) References Cited

U.S. PATENT DOCUMENTS

| | | | | |
|---|---|---|---|---|
| 5,369,432 | A | 11/1994 | Kennedy | |
| 5,796,384 | A | 8/1998 | Kim | |
| 5,987,167 | A | 11/1999 | Inoue | |
| 6,927,877 | B2 | 8/2005 | Kanno et al. | |
| 7,023,451 | B2 * | 4/2006 | Feng | 345/600 |
| 7,068,263 | B2 | 6/2006 | Evanicky et al. | |
| 7,068,283 | B2 | 6/2006 | Huang | |
| 7,085,414 | B2 * | 8/2006 | Tin | 382/167 |
| 7,176,938 | B2 | 2/2007 | Feng | |
| 7,180,436 | B2 | 2/2007 | Yoo | |
| 7,236,181 | B2 | 6/2007 | Ho et al. | |
| 2006/0126134 | A1 * | 6/2006 | Bala et al. | 358/504 |
| 2006/0262224 | A1 * | 11/2006 | Ha et al. | 348/582 |

OTHER PUBLICATIONS

Wu et al., A Channel-Dependent Display Color Calibration Using the Under-Color-Removal Method, AIC proceeding, Oct. 2009.
Chou et al., P-69: A Weighted Masking Model for Colorimetric Characterization of LCDs, SID 09 digest, p. 1367-p. 1370.
Roy S Berns, Methods for characterizing CRT displays, Displays vol. 16, No. 4, 1996, p. 173-182.

(Continued)

*Primary Examiner* — Amare Mengistu
*Assistant Examiner* — Hong Zhou
(74) *Attorney, Agent, or Firm* — Jianq Chyun IP Office

(57) ABSTRACT

A color calibrator of a display apparatus is disclosed. The color calibrator includes a color estimator for receiving a plurality of digital counts of initial colors of an image signal. The color estimator includes a first operator, a gray value electrical-optical converter, a mixed-color electrical-optical converter, an initial color electrical-optical converter, a plurality of linear transformers and a weighting operator. The gray value electrical-optical converter, the mixed-color electrical-optical converter and the initial color electrical-optical converter convert a gray value digital count, a mixed color digital count and an initial color digital count for generating a plurality conversion outputs according to a plurality of gray conversion curves, a plurality of mixed color conversion curves and a plurality of initial color converting curve. The weighting operator receives the conversion outputs and a plurality of weighting values to generate an analysis output signal.

7 Claims, 4 Drawing Sheets

OTHER PUBLICATIONS

Tamura et al., Masking model for accurate colorimetric characterization of LCD, Journal of the SID 11/2, 2003, p. 1-p. 7.
Neumann et al., An Interactive Perception Based Model for Characterization of Display Devices, Proceedings of the SPIE, vol. 5293, pp. 232-241 (2003).
Gibson et al., Colorimetric Characterization of Three Computer Displays (LCD and CRT), Munsell Color Science Laboratory Technical Report, Jan. 2000, p. 1-p. 40.
Day et al., Colorimetric Characterization of a Computer-Controlled Liquid Crystal Display, COLOR research and application, vol. 29, No. 5, Oct. 2004, p. 365-p. 373.
Yoshida et al., Color Calibration of LCDs, IS&T/SID Tenth Color Imaging Conference, p. 305-p. 310.
Katoh et al., An Accurate Characterization of CRT Monitor (I) Verifications of Past Studies and Clarifications of Gamma, Optical Review vol. 8, No. 5, 2001, p. 305-314.
Katoh et al., An Accurate Characterization of CRT Monitor (II) Proposal for an Extension to CIE Method and Its Verification, Optical Review vol. 8, No. 5, 2001, p. 397-408.
Kwak et al., Accurate Prediction of Colours on Liquid Crystal Displays, IS&T/SID Ninth Color Imaging Conference, p. 355-p. 359.
Chou et al., "P-69: A Weighted Masking Model for Colorimetric Characterization of LCDs," SID Symposium Digest of Technical Papers 40 (1), Jun. 4, 2009, pp. 1367-1370.
"Office Action of Japan counterpart application" issued on May 21, 2012, p1-p6, in which the listed reference was cited.

* cited by examiner

COLOR CALIBRATOR OF DISPLAY DEVICE

CROSS-REFERENCE TO RELATED APPLICATION

This application claims the priority benefit of Taiwan application serial no. 98140382, filed on Nov. 26, 2009. The entirety of the above-mentioned patent application is hereby incorporated by reference herein and made a part of this specification.

BACKGROUND OF THE INVENTION

1. Technical Field

The present invention relates to a color calibrator of a display device. More particularly, the present invention relates to a color calibrator in which the cross-talking of a display device is estimated.

2. Description of Related Art

As technology continues to advance and develop, people are eager for better material and spiritual enjoyments. When it comes to spiritual enjoyment, in the age of ever-changing technology, most people have the desire to realize their imagination and to experience the virtual reality effect with the help of various display devices.

The advancement of the photoelectric and semiconductor technologies motivates the thriving development of display devices. Among the various display apparatuses, liquid crystal display (LCD) is widely used and gradually replaces the cathode ray tube (CRT). Since the liquid crystal display provides the favorable features of reduced operation voltage, low power consumption, free radiation, reduced dimension and weight, etc., the liquid crystal display becomes the mainstream of display devices in recent years. However, consumers are also more critical and demanding on the color quality of the display image. Hence, enhancing the color quality of a display image is an essential issue to be pursued in the current display technology.

It is worth noting that if the digital counts of an image signal is used to directly generate the driving telecommunication signal for driving the display device, the display device would normally generate a displayed image, unexpected by the user. To compensate the above-mentioned error, gamma curves of the three initial colors (red, blue and green) are conventionally provided to convert and generate the electrical driving signal. When the display device receives the displayed image generated the converted driving telecommunication signal, and the displayed image is much closer to the expected image of the user. However, these conventional approaches fail to address the distortion problem resulted from the crosstalk phenomenon present in color mixing. Hence, an image displayed by a display device applying the conventional techniques is distorted to a great extent.

SUMMARY OF THE INVENTION

The invention provides a color calibrator of a display device, which is used for compensating the crosstalk between colors and enhancing the quality of the displayed image.

The present invention provides a color calibrator of a display device, the color calibrator includes a color estimator for receiving digital counts of a first initial color, a second initial color and a third initial color. The color estimator includes a first operator, a gray value electrical-optical converter, a mixed color electrical-optical converter, an initial color electrical-optical converter, a linear transformer and a weighting operator. The first operator performs mathematical operations on the digital counts of the first initial color, the second initial color and the third initial color to obtain a gray value digital count, a mixed color digital count and an initial color digital count. The gray value electrical-optical converter converts the gray value digital count to generate respectively a first converting output and a second converting output according to a plurality of gray converting curves and a plurality of mixed color converting curves. The mixed color electrical optical converter converts the mixed color digital count to generate respectively a third converting output and a fourth converting output according the plurality of gray converting curves and the plurality of initial color converting curves. The initial color electrical-optical converter converts the initial color digital count to generate a fifth converting output according an initial color converting curve. The linear transformer respectively receives the first converting output, the second converting output, third converting output, the fourth converting output and the fifth converting output to perform the linear transformation and to respectively obtain a first linear transformation output, a second linear transformation output, a third linear transformation output, a fourth linear transformation output and a fifth linear transformation output. The weighting operator receives the first, the second, the third, the fourth and the fifth liner transformation outputs and the gray weighting value, the mixed color weighting value and the initial color weighting value, and generates an analysis output signal according to the operation result of the first linear transformation output and the mixed color weighting value, the operation result of the second and the third linear transformation outputs and the mixed color weighting value, and the operation result of the fourth and the fifth liner transformation outputs and the initial color weighing value.

In accordance to an exemplary embodiment of the invention, the above color calibrator also includes an electrical driving signal generator for receiving the digital counts of the first initial color, the second initial color and the third initial color of the image signal. The electrical driving signal generator includes a target electrical-optical converter, a second operator and an electrical-optical inverse converter. The target electrical-optical converter receives the digital counts of the first initial color, the second initial color and the third initial color and performs electrical-optical conversion to generate a first target initial color, a second target initial color and a third target initial color. The second operator receives the first, the second, and the third target initial colors and performs mathematical operation to obtain a target gray value digital count, a target mixed color digital count and a target initial color digital count. The electrical-optical inverse converter receives the target gray value digital count, the target mixed color digital count and the target initial color digital count and performs an inverse conversion on the target gray value digital count, the target mixed color digital count and the target initial color digital count to generate an applied gray value digital count, an applied mixed color digital count and an applied initial color digital count, wherein the inverse conversion is the inverse operation of the signal conversion and operation performed by the gray value electrical-optical converter, the mixed color electrical-optical converter, the initial color electrical-optical converter, the linear transformer and the weighting operator of the color estimator.

In accordance to the above, the color calibrator of the display device of the invention includes the incorporation of an initial color conversion curve, a gray conversion curve and a mixed color converting curve to perform the color estimation in order to eliminate the image distortion of the display device generated by the crosstalk phenomenon. Further, the operation is performed by applying the gray weighting value corresponding to the gray value digital count, the mixed color weighting value corresponding to the mixed color digital count, and the initial color weighting value corresponding to the initial color digital count to reduce the error between the display effect actually detected by the display device and the theoretical value. Hence, the overall image display quality of the display device is effectively enhanced.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 1:
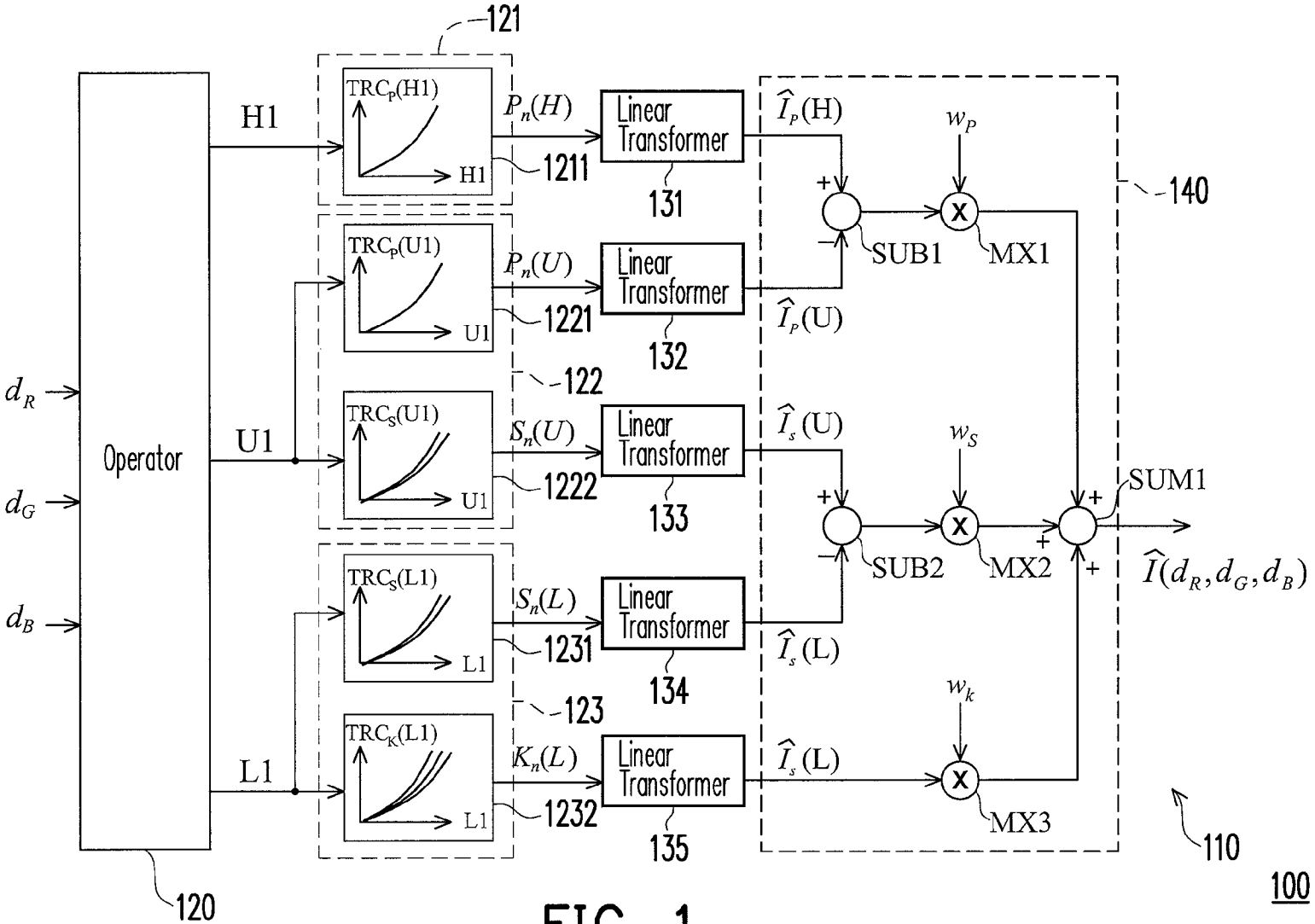
FIG. 1 is a schematic diagram illustrating a color estimator 110 of a color calibrator 100 of a display device according to an exemplary embodiment of the invention.

Referring to FIG. 1, FIG. 1 is a schematic diagram illustrating a color estimator 110 of a color calibrator 100 of a display device. The color estimator 110 is used for receiving the digital counts $d_R$, $d_G$, and $d_B$ of the three initial colors (for example, red, green and blue) of an image signal. The color estimator 110 includes an operator 120, a gray value electrical-optical converter 123, a mixed color electrical-optical converter 122, an initial color electrical-optical converter 121, a plurality of linear transformers 131 to 135 and a weighting operator 140.

The operator 120 receives and performs mathematical operations on the digital counts $d_R$, $d_G$, and $d_B$ of the three initial colors, wherein the digital count $d_R$, $d_G$, and $d_B$ of the three initial colors respectively represent the red digital count, the green digital count and the blue digital count in the image signal. Subsequent to the mathematical operations, a gray value digital count L1, a mixed color digital count U1 and a initial color digital count H1 are generated.

Figure 2B:
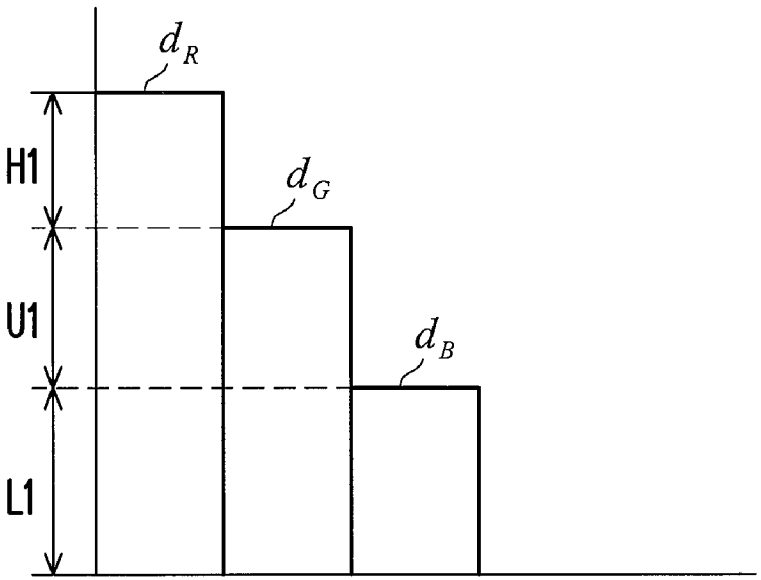
FIGS. 2A and 2B respectively illustrate the implement circuit diagram and the implement theory diagram of the operator 120 according to an exemplary embodiment of the invention.
Figure 2A:
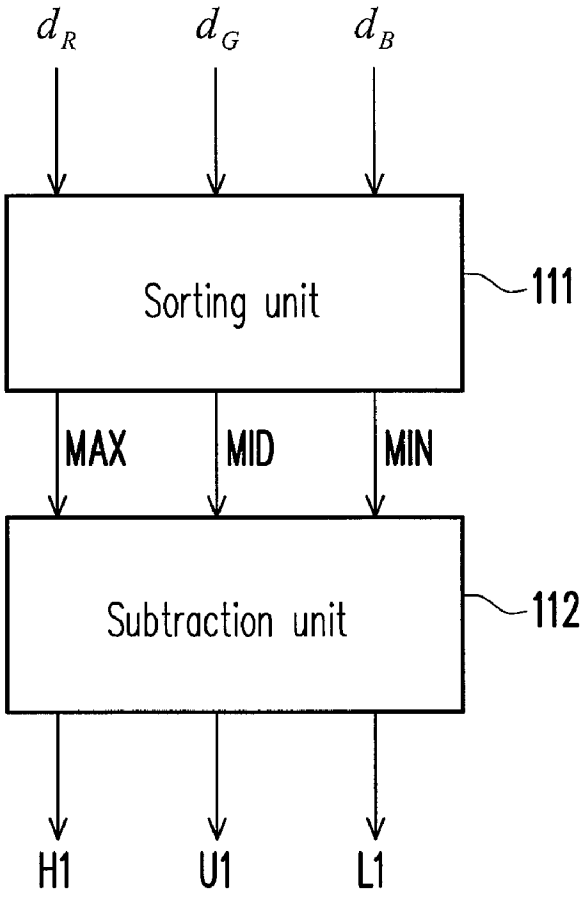

The implementation of the operator 120 is better illustrated by concurrently referring to the FIGS. 1, 2A and 2B, wherein FIGS. 2A and 2B respectively illustrate the implement circuit diagram and the implement theory diagram of the operator 120. In FIG. 2A, the operator 120 is implemented with a sorting unit 111 and a subtraction unit 112 connected in serial. The sorting unit 111 receives and sorts the digital counts $d_R$, $d_G$, and $d_B$ of the three initial colors according to the sizes of the digital counts. The sorting unit 111 sorts out the maximum of the digital counts $d_R$, $d_G$, and $d_B$ of the initial color as the maximum digital count MAX, sorts out the second largest of the digital counts $d_R$, $d_G$, and $d_B$ of the initial color as the middle digital count MID, and the minimum of the digital counts $d_R$, $d_G$, and $d_B$ of the initial color as the minimum digital count MIN.

Thereafter, the subtraction unit 112 receives and performs the subtraction operation on the maximum digital count MAX, the middle digital count MID and the minimum digital count MIN. The subtraction unit 112 subtracts the minimum digital count MIN from the middle digital count MID to obtain a mixed color digital count U1, and the middle digital count MID from the maximum digital count MAX to obtain an initial color digital count H1. The subtraction unit 112 also outputs the minimum digital count as the gray value digital count L1.

In FIG. 2B, for example, the sorting unit 111 sorts out the maximum digital count MAX as the digital count $d_R$ of the initial color, the middle digital count MID as the digital count $d_G$ of the initial color and the minimum digital count MIN being $d_B$ of the initial color. Hence, the subtraction unit 112 directly outputs the digital count $d_B$ of the initial color as the gray value digital count L1. Further, the subtraction unit 112 further subtracts the minimum digital count MIN (which is equivalent to the digital count $d_B$ of the initial color) from the middle digital count MID (which is equivalent to the digital count $d_G$ of the initial color) to obtain the mixed color digital count U1, and the middle digital count MID (which is equivalent to the digital count $d_G$ of the initial color) from the maximum digital count MAX (which is equivalent to the digital count $d_R$ of the initial color) to obtain the initial color digital count H1.

Referring to FIG. 1, the gray value electrical-optical converter 123, the mixed color electrical-optical converter 122 and the initial color electrical-optical converter 121 are coupled to the operator 120, and respectively receive the gray value digital count L1, the mixed color digital count U1, and the initial color digital count H1. The initial color electrical-optical converter 121 performs a conversion on the initial color digital count H1 to generate a conversion output $P_n(H)$ according to the initial color conversion curve 1211. The mixed color electrical-optical converter 122 performs a conversion on the mixed color digital count U1 to generate a conversion output $S_n(U)$ according to the mixed color conversion curve 1222. The mixed color electrical-optical converter 122 performs a conversion on the mixed color digital count U1 to generate a conversion output $P_n(U)$ according to the initial color conversion curve 1221. The gray value electrical-optical converter 123 performs a conversion on the gray value digital count L1 to generate a conversion output $K_n(L)$ according to the gray value conversion curve 1232. The gray value electrical-optical converter 123 performs a conversion on the gray value digital count L1 to generate a conversion output $S_T(L)$ according to the mixed color conversion curve 1231.

It is worth noting that the above initial color conversion curves 1211, 1221 are the gamma conversion curves required for the conversion of the initial color (for example, one of the red, blue and green of the three initial colors), while the mixed color conversion curves 1222, 1231 are the gamma conversion curves required for the conversion of a mixed color (for example, yellow, cyan or magenta) formed by the mixing of two initial colors. Correspondingly, the gray value conversion curve 1232 are the gamma conversion curves required for the conversion of the gray value (only brightness) formed by the mixing of the three initial colors. Since under the situation that more than one initial color are being mixed together, different gamma curves are required for the different color-mixing conditions due to the crosstalk between colors.

For example, the three initial colors (red, blue and green) require three different gamma conversion curves, while the three mixed colors (yellow, cyan and magenta) requires six different gamma conversion curves (each mixed color corresponds to two gamma conversion curves, such as yellow requires the gamma curves of red and green). Further, gray requires three different gamma conversion curves (the gamma curves of red, blue and green). In other words, the color calibrator 100 requires 12 different gamma conversion curves.

Moreover, the above different gamma conversion curves are established according to the actual measured digital counts obtained using the display device applicable for the color calibrator 100. Simply speaking, the relationship between the driving signal and the display light signal measured in accordance to all yellow (or other colors or gray) displayed by the display device is used to establish the different gamma conversion curves.

The above conversion outputs $P_n(H)$, $P_n(U)$, $S_n(U)$, $S_n(L)$ and $K_n(L)$ respectively output to the linear transformers 131 to 135 for linear transformation to generate linear transformation outputs $\hat{I}_P(H)$, $\hat{I}_P(U)$, $\hat{I}_S(H)$, $\hat{I}_S(U)$ and $\hat{I}_K(L)$.

The weighting operator 140 receives the linear transformation outputs $\hat{I}_P(H)$, $\hat{I}_P(U)$ and the gray weighting value $W_K$, the mixed color weighting value $W_S$, and the initial color weighting value $W_P$. The weighting operator 140 generates an analysis output signal $\hat{I}(d_R, d_G, d_B)$ according to the operation result of the linear transformation output $\hat{I}_K(L)$ and the gray weighting value $W_K$, the operation result of the linear transformation output $\hat{I}_S(U)$ and the mixed color weighting value $W_S$, and the operation result of the linear transformation outputs $\hat{I}_P(H)$, $\hat{I}_P(U)$ and the mixed color weighting value $W_P$.

It is worthy to note, the above gray weighting value $W_K$, mixed color weighting value $W_S$, and the initial color weighting value $W_P$ are obtained by applying the error between the measured number obtained using the display device applicable for the color calibrator 100 and the theoretical value, and performing an optimization calculation of the minimum mean square error method on the error. Since the above method is familiar to one skilled in the art, the details thereof will not be reiterated herein.

Further, one may learn how the color condition of the treated image signal appear to human eyes by corresponding the analysis output signal $\hat{I}(d_R, d_G, d_B)$ with the CIE chromaticity diagram. In other words, the user may obtain the display condition of the treated image signal that ought to appear based on the analysis output signal $\hat{I}(d_R, d_G, d_B)$. Further, the user can also obtain the related information required for the performance of color calibration from the analysis output signal $\hat{I}(d_R, d_G, d_B)$. For example, the user may accomplish color calibration by moving the position of the analysis output signal $\hat{I}(d_R, d_G, d_B)$ on the CIE chromatic diagram by changing the sizes of the gray value weighting value $W_K$, the mixed color weighting value $W_S$ and the initial color weighting value $W_P$.

Regarding the method of implementation of the weighting operator 140, the weighting operator 140 includes multiplication units MX1 to MX3, subtraction units SUB1 to SUB2 and a summation unit SUM1. The multiplication unit MX1 multiplies the liner transformation output $\hat{I}_K(L)$ with the gray value weighting value $W_K$ to obtain a first multiplication result. The subtraction unit SUB2 performs a subtraction between the linear transformation outputs $\hat{I}_P(H)$ and $\hat{I}_P(L)$, and the subtraction result is multiplied by the mixed color weighting value $W_S$ via the multiplication unit MX2 to obtain a second multiplication result. The subtraction unit SUB1 then performs a subtraction operation between the linear transformation outputs $\hat{I}_P(H)$ and $\hat{I}_P(U)$, and the subtraction result is multiplied by the initial color weighting value $W_P$ via the multiplication unit MX3 to obtain a third multiplication result. The summation unit SUM1 then adds the first, the second and the third multiplication results to obtain the analysis output signal $\hat{I}(d_R, d_G, d_B)$.

Figure 3:
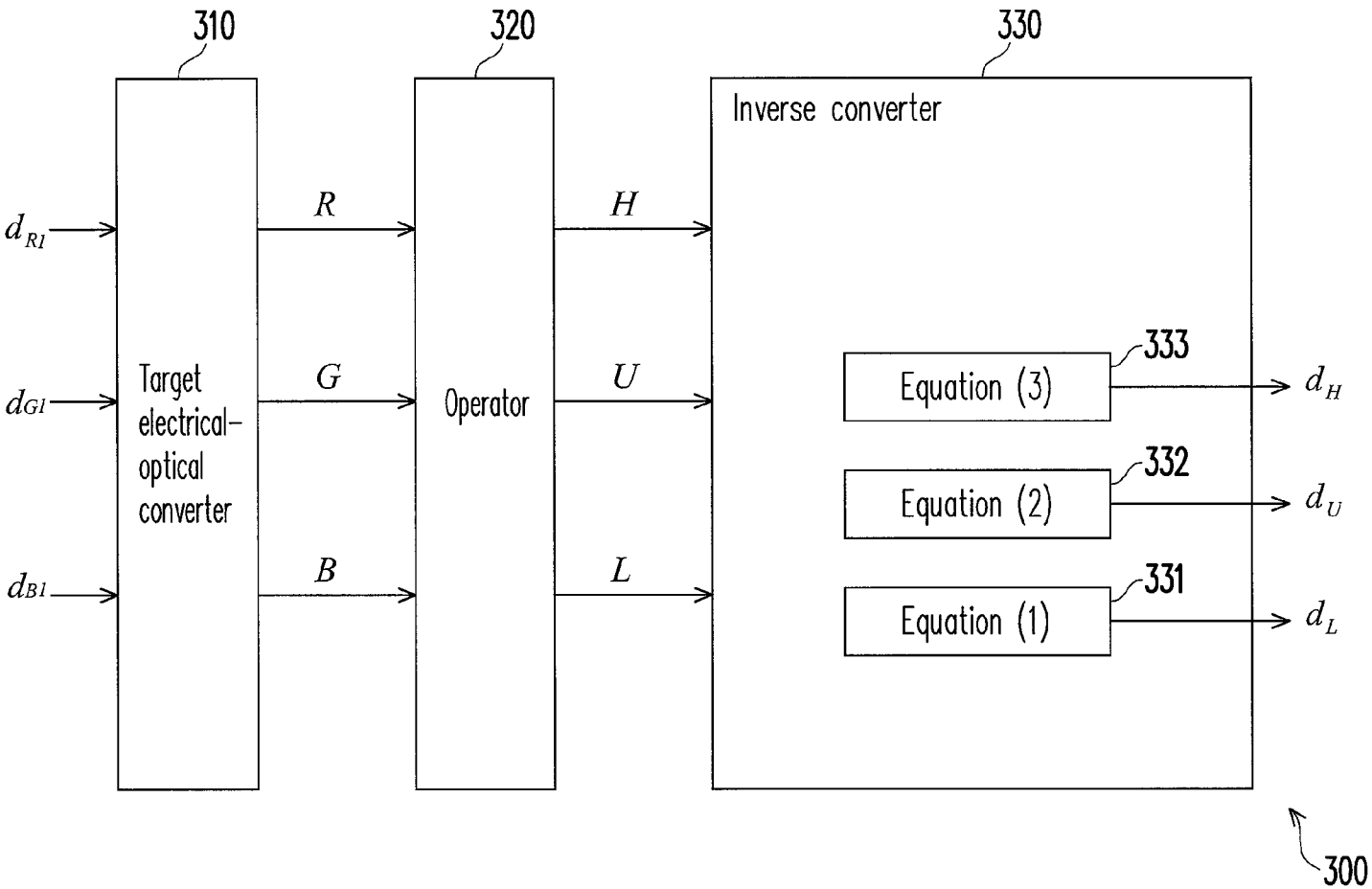
FIG. 3 is a schematic diagram of an electrical driving signal generator 300 of a color calibrator 100 according to an exemplary embodiment of the invention.

Referring to FIG. 3, FIG. 3 is a schematic diagram of an electrical driving signal generator 300 of a color calibrator 100 according to an exemplary embodiment of the invention. The electrical driving signal generator 300 includes a target electrical-optical converter 310, an operator 320 and an electrical-optical inverse converter 330. The electrical driving signal generator 300 receives the digital counts $d_{R1}$, $d_{G1}$, $d_{B1}$ of the three initial colors of the image signal. The digital counts $d_{R1}$, $d_{G1}$, $d_{B1}$ of the initial colors refer herein are equivalent to the digital counts $d_{R1}$, $d_{G1}$, $d_{B1}$ of the initial colors provided to the color estimator 110. The target electrical-optical converter 310 receives and performs electrical-optical conversion on the digital counts $d_{R1}$, $d_{G1}$, $d_{B1}$ of the initial colors to generate a target initial red color R, a target initial green color and a target initial blue color B.

The operator 320 receives and performs mathematical operation on the target initial colors R, G, B, to obtain a target gray value digital count L, a target mixed color digital count U and a target initial color digital count H. The operation theory and method of the operator 320 are similar to those described above and will not be further reiterated herein.

The electrical-optical inverse converter 330 receives and performs an inverse conversion on the target gray value digital count L, the target mixed color digital count U and the target initial color digital count H to generate an applied gray value digital count $d_L$, an applied mixed color digital count $d_U$ and an applied initial color digital count $d_H$.

It is worth noting that the above inverse conversion is an inverse operation of the signal conversion according to the gray value electrical-optical converter 123, the mixed color electrical-optical converter 122, the initial color electrical-optical converter 121, the linear transformers 131 to 135 and weighting operators of the color estimator 110. The relationships between target gray value digital count L, the target mixed color digital count U and the target initial color digital count H, and the applied gray value digital count $d_L$, the applied mixed color digital count $d_U$ and the applied initial color digital count $d_H$ are represented by the following mathematical equations (1), (2) and (3):

$$d_L = TRC_{k(L)}^{-1}\left[\frac{L}{w_K}\right] \tag{1}$$

$$d_U = TRC_{s((H,U),U)}^{-1}\left[\frac{U}{w_S} + \left[TRC_{s((H,U),U)}(d_L) - \frac{w_K}{w_S}\cdot TRC_{k(U)}(d_L)\right]\right] \tag{2}$$

$$d_H = TRC_{p(H)}^{-1}\left[\begin{array}{c}\frac{H}{w_P} + \left[\frac{w_s}{w_p}\cdot TRC_{s((H,U),H)}(d_L) - \frac{w_K}{w_P}\cdot TRC_{k(H)}(d_L)\right] + \\ \left[TRC_{p(H)}(d_U) - \frac{w_s}{w_p}\cdot TRC_{s((H,U),H)}(d_U)\right]\end{array}\right] \tag{3}$$

Wherein $TRC_{k(L)}^{-1}$ is the inverse operation of the gray value conversion curve of the corresponding gray value digital count L, $TRC_{s((H,U),U)}^{-1}$ is the inverse operation of the mixed color conversion curve of the corresponding mixed color digital count U and the initial color digital count, while the $TRC_{p(H)}^{-1}$ is the inverse operation of the initial i color conversion curve of the corresponding initial color digital count H. Moreover, $TRC_{k(U)}$ is the inverse operation of the gray conversion curve of the corresponding initial digital count U, $TRC_{k(H)}$ is the inverse operation of the initial conversion curve of the corresponding initial digital count H, and $TRC_{s((H,U),U)}$, $TRC_{s((H,U),H)}$ are the inverse operations of the mixed color conversion curves of the mixed color digital count U and the initial color digital count H.

Still referring to FIG. 3, the modules 331 to 333 used by the electrical-optical inverse converter 330 for implementing the mathematical equations (1) to (3) may apply a look-up table method. In a digital system, a designer may apply the actual mathematical equation s (1) to (3) to the gray value digital count L, the mixed color digital count U and the initial color digital count H of different numeral values to obtain plural sets of the applied gray value digital count $d_L$, the applied mixed color digital count $d_U$ and the applied initial color digital count $d_H$. Then, further based on the relationships between the initial color digital count H, the mixed color digital count U and the calculated gray value digital count L, and the applied gray value digital count $d_L$, the applied mixed color digital count $d_U$ and the applied initial color digital count $d_H$, a look-up table is established. The look-up table is used to implement modules 331 to 333, and to correspondingly identify the applied gray value digital count $d_L$, the applied mixed color digital count $d_U$ and the applied initial color digital count $d_H$, based on the received initial color digital count H, the mixed color digital count U and the gray value digital count L.

It is worthy to note that the above look-up table may be stored in a memory unit (a memory, a magnetic drive, etc. provided for the storage of information), and the memory unit may be built in the electrical-optical inverse converter 330 or externally attached to and read by the electrical-optical inverse converter 330.

Reference will now be made in detail to an exemplary embodiment which will describe a display color calibrator that combines a color estimator and an electrical driving signal generator.

Figure 4:
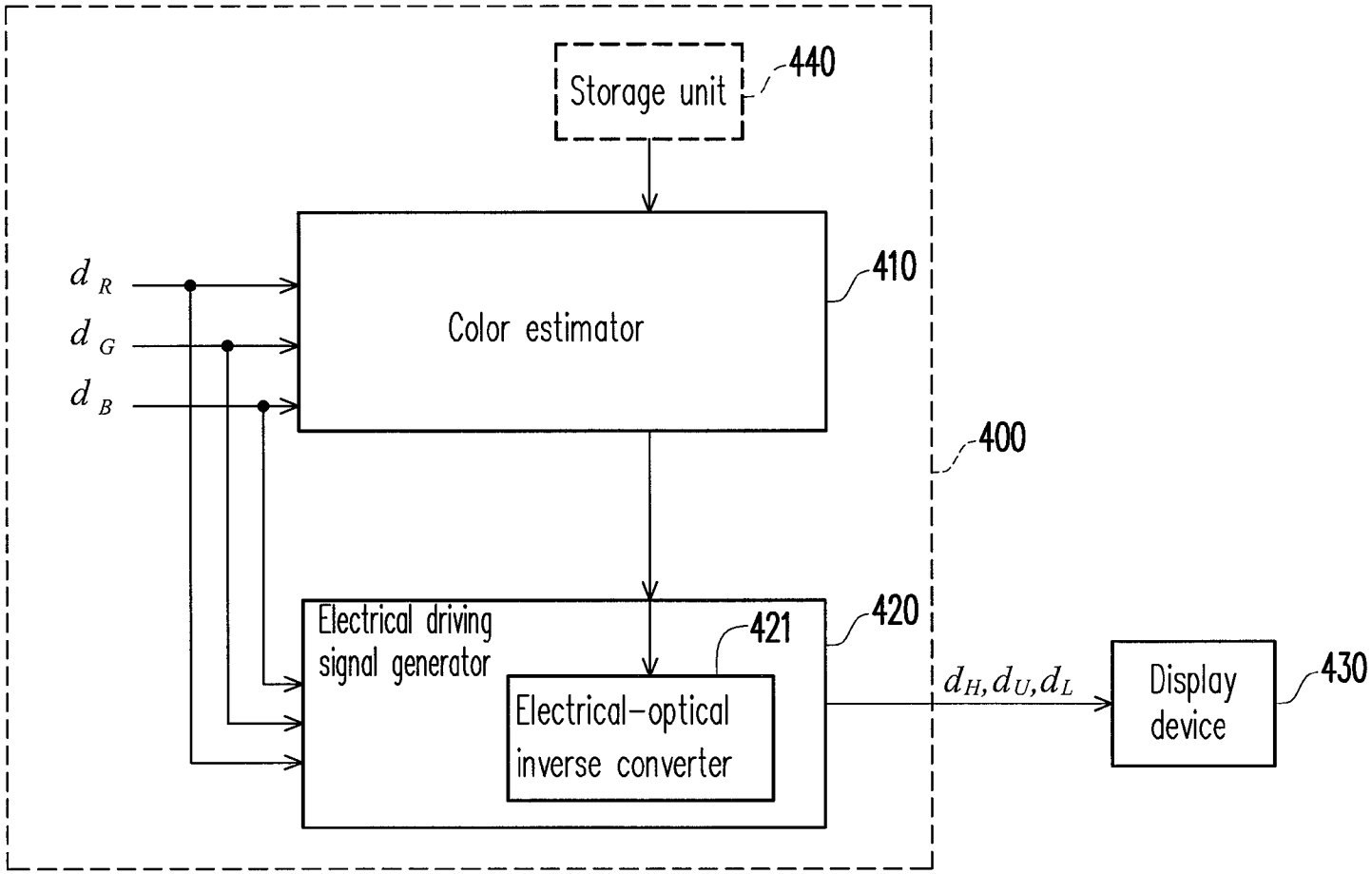
FIG. 4 is a schematic diagram of a display color calibrator 400 according to another exemplary embodiment of the invention.

Referring to FIG. 4, FIG. 4 is a schematic diagram of a display color calibrator 400 according to another exemplary embodiment of the invention. The color calibrator 400, which is applicable for a display device 430, includes a color estimator 410 and an electrical driving signal generator 420. The color estimator 410 reads, through an externally attached (or internally built-in) storage unit 440, the gray value conversion curve, the mixed color conversion curve and the initial color conversion curve stored using the look-up table method. The storage unit 440 may also used to store the gray weighting value, the mixed color weighting value and the initial color weighting value.

The color estimator 410 receives and estimates the digital counts $d_R$, $d_G$ and $d_B$ of the initial colors. The color estimator 410 also provides the related information for the using of the gray conversion curve, the mixed color conversion curve and the initial color conversion curve, and the gray weighting value, the mixed color weighting value and the initial color weighting value, etc., to the electrically driving signal generator 420 in order for the electrical driving signal generator 420 to implement the electrical-optical inverse converter 421 using the look-up table.

The electrical driving signal generator 420 similarly receives the digital counts $d_R$, $d_G$ and $d_B$ of the initial colors to generate the applied gray value digital count $d_L$, the applied mixed color digital count $d_U$ and the applied initial color digital count $d_H$ based on the inverse operation of the electrical-optical inverse converter 421. Concurrently, the driving signal generator 420 output the applied gray value digital count $d_L$, the applied mixed color digital count $d_U$ and the applied initial color digital count $d_H$ to the display device 430. The display device 430 thereby displays an image free from distortion generated due to the crosstalk between colors during the mixing of colors. The display device displays an image corresponding to the image signal according to a base color separation method.

Moreover, in an exemplary embodiment of the invention, when the display device 430 is being replaced, by storing the gray value conversion curve, the mixed color conversion curve and the initial color conversion curve, and the gray weighting value, the mixed color weighting value and the initial color weighting value, etc., of the newly connected display device in the memory unit 440, the color calibrator 400 can effectively display an image free of distortion generated due the crosstalk phenomenon.

According to the above disclosure, the color calibrator of the invention relies on the incorporation of information of the gray conversion curve, the mixed color conversion curve and the initial color conversion curve, and the gray weighting value, the mixed color weighting value and the initial color weighting value, etc. to perform the color estimation. Further, based on the inverse operation performed according to the gray value conversion curve, the mixed color conversion curve and the initial color conversion curve, and the gray weighting value, the mixed color weighting value and the initial color weighting value, etc., the display device generates an electrical driving signal of a distortion-free display image, wherein the distortion of an image is resulted from the crosstalk phenomenon.

Although the disclosure herein refers to certain illustrated embodiments, it is to be understood that these embodiments are presented by way of example and not by way of limitation. The intent of the detailed description is to cover all modifications, alternatives, and equivalents as may fall within the spirit and scope of the invention as defined by the appended claims. Moreover, any embodiment of the invention or claims to achieve all the features, advantages or characteristics disclosed in the invention. Additionally, the abstract and the title of the invention are intended to facilitate patent search and not intended to be restrictive of the spirit and scope of the invention.

What is claimed is:

1. A color calibrator of a display device, the color calibrator comprising:

a color estimator, receiving digital counts of a first initial color, a second initial color and a third initial color of an image signal, the color estimator comprising:

a first operator, performing a mathematical operation on the digital counts of the first initial color, the second initial color and the third initial color to obtain a first gray value digital count, a mixed color digital count and an initial color digital count;

a gray value electrical-optical converter, converting the gray value digital count according to a plurality of gray value conversion curves and a plurality of mixed color conversion curves to respectively generate a first conversion output and a second conversion output;

a mixed color electrical-optical converter, converting the mixed color digital count according to the plurality of mixed color conversion curves and a plurality of initial color conversion curves to respectively generate a third conversion output and a fourth conversion output;

an initial color electrical-optical converter, converting the initial color digital count according to the plurality of initial color conversion curves to generate a fifth conversion output;

a plurality of linear transformers, respectively receiving the first conversion output, the second conversion output, the third conversion output, the fourth conversion output and the fifth conversion output and performing linear transformations to respectively obtain a first linear transformation output, a second linear transformation output, a third linear transformation output, a fourth linear transformation output and a fifth linear transformation output; and a weighting operator, receiving the first linear transformation output, the second linear transformation output, the third linear transformation output, the fourth linear transformation output and the fifth linear transformation output, and a gray weighting value, a mixed color weighting value and an initial color weighting value, and generating an analysis output signal based on an operation result of the first liner transformation output and the gray weight value, an operation result of the second linear transformation output, the third linear transformation output and the mixed color weighting value, and an operation result of the fourth linear transformation output and the fifth linear transformation output and the initial color weight value; and an electrical driving signal generator, receiving the digital counts of the first initial color, the second initial color and the third initial color of the image signal, the electrical driving signal generator comprising:

a target electrical-optical converter, receiving the digital counts of the first initial color, the second initial color and the third initial color to generate a first target initial color, a second target initial color and a third target initial color;

a second operator, receiving the first target initial color, the second target initial color and the third target initial color and performing the mathematical operation to obtain a target gray value digital count, a target mixed color digital count and a target initial color digital count; and an electrical-optical inverse converter, receiving the target gray value digital count, the target mixed color digital count and the target initial color digital count and performing an inverse conversion on the target gray value digital count, the target mixed color digital count and the target initial color digital count to generate an applied gray value digital count, an applied mixed color digital count and an applied initial color digital count, wherein the inverse conversion is an inversion operation of a signal conversion and operation performed by the gray value electrical-optical converter, the mixed color electrical-optical converter, the initial color electrical-optical converter, the plurality of linear transformers and the weighting operator.

2. The color calibrator of claim 1, wherein the first operator comprises:

a sorting unit, sorting out sizes of the digital counts of the first initial color, the second initial color and the third initial color to obtain a first maximum digital count, a first middle digital count and a first minimum digital count; and a subtraction unit, subtracting the first minimum digital count from the first maximum digital count and subtracting the first middle digital count from the first maximum digital count, and directly outputting the first minimum digital count to obtain a gray value digital count.

3. The color calibrator of claim 1, wherein the plurality of gray value conversion curves, the plurality of mixed color conversion curves and the plurality of initial color conversion curves comprised by the gray value electrical-optical converter, the mixed color electrical-optical converter and the initial color electrical-optical converter are obtained based on a relationship between a plurality of electrical driving signals received by the display device and a plurality of correspondingly outputted light signals.

4. The color calibrator of claim 3, wherein the weighting operator comprises:

a first multiplication unit, multiplying the first linear transformation output and the gray weighting value to obtain a first multiplication result;

a subtraction unit, subtracting the second linear transformation output from the third linear transformation output to obtain a first subtraction output;

a second multiplication unit, multiplying the first subtraction result with the mixed color weighting value to obtain a second multiplication result;

a second subtraction unit, subtracting the fourth linear transformation output from the fifth linear transformation output to obtain a second subtraction result;

a third multiplication unit, multiplying the second subtraction result with the initial color weighting value to obtain a third multiplication result; and a summation unit, adding the first multiplication result, the second multiplication result and the third multiplication result to obtain the analysis output signal.

5. The color calibrator of claim 1, wherein the second operator comprises:

a sorting unit, sorting out digital counts of the first target initial color, the second target initial color and the third target initial color according to sizes of the digital counts of the first target initial color, the second target initial color and the third target initial color to obtain a second maximum digital count, a second middle digital count, a second minimum digital count; and a subtraction unit, subtracting the second minimum digital count from the second maximum digital count to obtain the target mixed color digital count and subtracting the target mixed color digital count from the second maximum digital count to obtain the target initial color digital count, and directly outputting the second minimum digital count as the target gray value digital count.

6. The color calibrator of claim 1, wherein the applied gray value digital count, the applied mixed color digital count and the applied initial color digital count are provided to the display device, and the display device displays an image corresponding to the image signal according to a base color separation method.

7. The color calibrator of claim 1, further comprising:

at least a storage unit, storing the plurality of gray value conversion curves the plurality of mixed color conversion curves, the plurality of initial color conversion curves with a look-up table method, and for storing the gray weighting value, the mixed color weighting value and the initial color weighting value.

* * * * *